United States Patent [19]

Nitschmann

[11] Patent Number: 4,979,416

[45] Date of Patent: Dec. 25, 1990

[54] CUTTING LINK FOR A SAW CHAIN

[75] Inventor: Karl Nitschmann, Schorndorf, Fed. Rep. of Germany

[73] Assignee: Andreas Stihl, Waiblingen, Fed. Rep. of Germany

[21] Appl. No.: 352,464

[22] Filed: May 16, 1989

[30] Foreign Application Priority Data

May 21, 1988 [DE] Fed. Rep. of Germany ..... 3817436

[51] Int. Cl.[5] ..... B27B 33/14

[52] U.S. Cl. ..... 83/834; 83/830

[58] Field of Search ..... 83/830–834; 30/381

[56] References Cited

U.S. PATENT DOCUMENTS

| | | | |
|---|---|---|---|
| 2,736,352 | 2/1956 | Wright | 83/834 X |
| 3,176,733 | 4/1965 | Dobbertin | 83/834 |
| 3,951,027 | 4/1976 | Arff | 83/834 |

FOREIGN PATENT DOCUMENTS

| | | | |
|---|---|---|---|
| 1000170 | 11/1976 | Canada | 83/834 |

*Primary Examiner*—Hien H. Phan
*Assistant Examiner*—Rinaldi Rada
*Attorney, Agent, or Firm*—Walter Ottesen

[57] ABSTRACT

The invention is directed to a cutting link for a saw chain of a motor-driven chain saw. Since the cutting links of the saw chain wear differently at the forward and rearward running surfaces, the cutting link tilts in a direction opposite to the direction of movement of the saw chain whereby a free angle conjointly defined by the roof of the cutting tooth and the cutting plane becomes larger. However, a larger free angle changes the cutting performance of the saw chain. In order to obtain an approximately uniform cutting performance over a longer period of operational use, the tooth roof can be configured over its length to define free angles which become smaller whereby the enlargement of the free angle occurring during the tilting of the cutting link caused by wear is compensated.

17 Claims, 4 Drawing Sheets

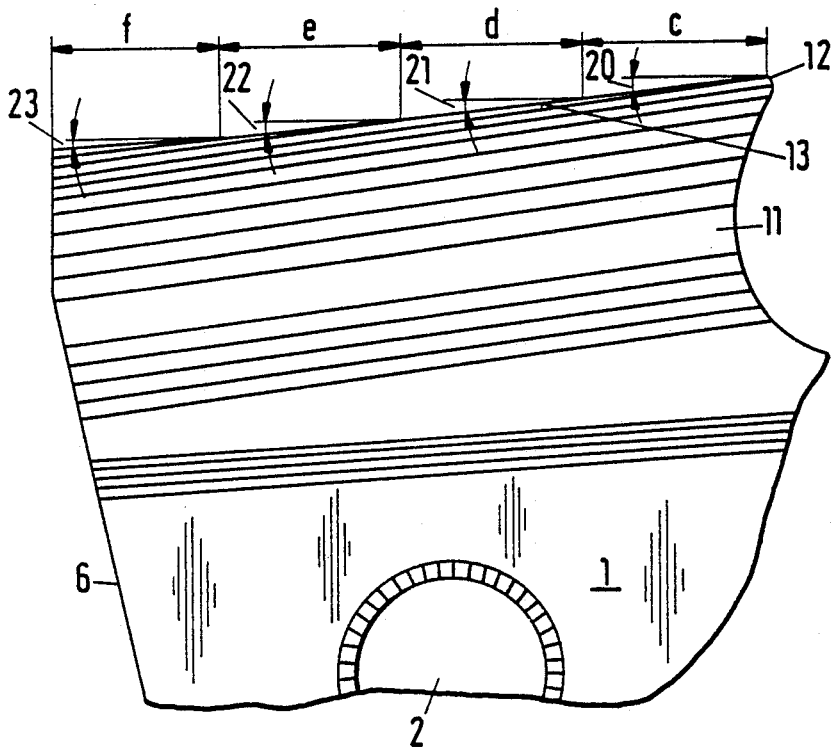
Fig.2
Fig.3
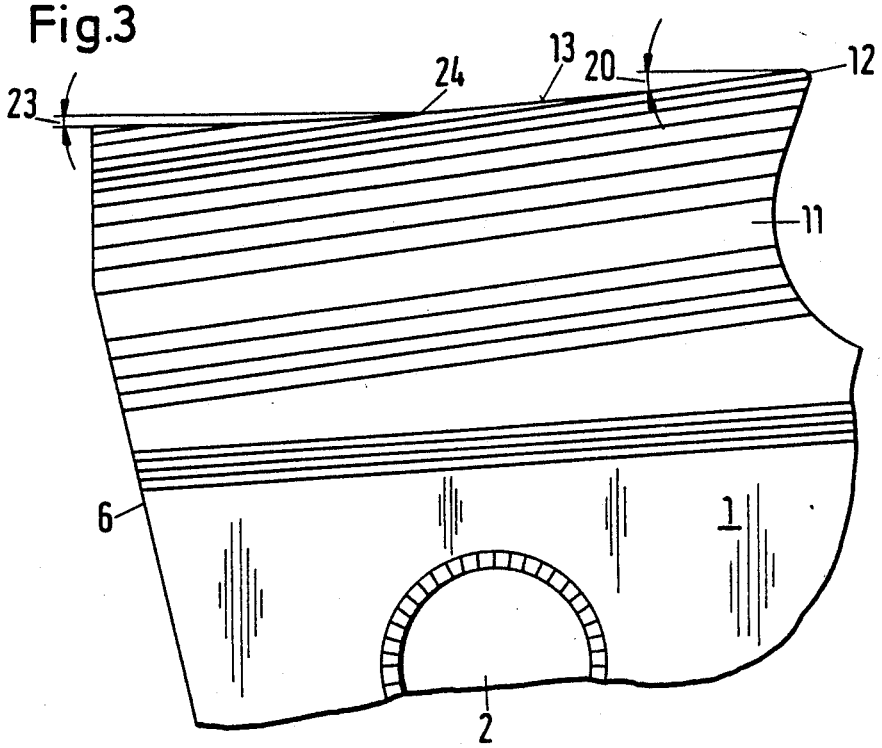

CUTTING LINK FOR A SAW CHAIN

FIELD OF THE INVENTION

The invention relates to a cutting link for chain for a motor-driven chain saw having a guide bar defining a track for guiding the saw chain. The saw chain includes a plurality of cutting links and a plurality of other links. These links are pivotally interconnected by rivets to define the saw chain. Each of the cutting links includes a base body having a rearward wall portion defining a trailing rivet opening for accommodating one of the rivets and a forward wall portion defining a leading rivet opening for accommodating another one of the rivets. The base body has a lower edge defining a rearward running surface approximately beneath the trailing rivet opening and a forward running surface approximately beneath the leading rivet opening. The rearward wall portion extends upwardly to form a cutting tooth defining a cutting edge which moves in a cutting plane. The cutting tooth has a tooth roof which extends rearwardly of the cutting edge. The tooth roof and the cutting plane conjointly define a free angle.

BACKGROUND OF THE INVENTION

Such cutting links are arranged as chain links in a saw chain as described above. The cutting links alternate as right-hand cutting links and left-hand cutting links on each side of the saw chain. The saw chain further includes center links and additional side links which are pivotally interconnected by means of rivets.

The side links arranged on each side of the saw chain and the cutting links have a lower edge defining a forward running surface and a rearward running surface by means of which the saw chain is guided on the guide surface of a guide slot in the guide bar of a motor-driven chain saw.

If the running surfaces of the cutting link lie firmly on the guide surface then the tooth roof which extends behind the cutting edge defines a free angle with the cutting plane. The free angle is absolutely necessary for the function of the cutting edge. The free angle must be so configured that on the one hand a good engagement of the cutting edge into the wood is assured in order that a constant cutting capacity is obtained while, on the other hand, an uncontrolled and too deep an engagement is reliably prevented. Too deep an engagement in the wood leads to an uneven cutting performance and can lead to a kickback of the guide bar in the direction of the person operating the chain saw which would present a considerable danger to the person.

An even cutting performance is mostly obtained by having a precise matching of the free angle in combination with the depth limiters which are positioned ahead of the cutting edge. Another suggestion provides a guide hump at the rearward end of the tooth roof which, together with the depth limiter, is intended to provide an optimal engagement of the cutting edge.

A uniform cutting performance with constant cutting capacity can be determined for the saw chain when it is in the new condition by means of a special configuration of the individual links and especially by means of the configuration of the cutting link. With increasing wear of the saw chain, saw chain vibrations can, however, occur which lead to an uneven cutting performance and reduce cutting capacity Known saw chains are to be exchanged already after being in operation for a predetermined time.

SUMMARY OF THE INVENTION

It is an object of the invention to provide a cutting link for a saw chain of a motor-driven chain saw such that even after a longer operational time and frequent resharpening, a vibration-free running of the saw chain and a uniform cutting performance are obtained for an approximately constant cutting capacity.

The invention is based on the premise that the rearward running surface of the base body shows considerably more wear than the forward running surface. The reason for this appears to be that the forces applied to the cutting edge load the rearward running surface more than the forward running surface which is relieved of load because of the kinematic action on the cutting link.

The cutting tooth tilts to the rear opposite to the running direction because of the greater wear of the rearward running surface. This causes the position of the tooth roof to change with respect to the cutting plane so that the free angle becomes greater.

Parallel to the wear of the rearward running surface, the tooth roof is likewise worn away because of the required resharpening operations whereby the cutting edge comes ever closer to the segment of the tooth roof which defines the smaller free angle. According to the invention, the free angle of the tooth roof becomes smaller with increasing wear of the cutting edge because of the given configuration of the cutting link; however, on the other hand, because of the wear of the rearward running surface caused by operational use, the cutting link tilts in a direction opposite to the running direction so that the position of the tooth roof with respect to the cutting plane changes so as to make the free angle larger. For these reasons, the free angle can be maintained even after longer operational use within a certain magnitude which is required for obtaining a uniform cutting performance and a vibration-free running of the saw chain. The free angle extending from the cutting edge is preferably about 7° whereas the follow-on smaller free angle is selected in the range between 3° and 6° and is preferably 5°.

A significantly reduced inclination to kickback has been determined with proper manipulation of a motor-driven chain saw equipped with a saw chain according to the invention.

The tooth roof can advantageously have two or more straight segments with ever smaller free angles with the change in the magnitude of the free angle being discontinuous in a direction opposite to the running direction of the saw chain. However, it is preferable that the change of the free angle be continuous with the tooth roof being configured especially as a curve which can have a convex form.

According to another feature of the invention, the running surfaces of the cutting link can be modified. The rearward running surface is configured so as to be longer than the forward running surface such that the amount lost through wear at both running surfaces is approximately the same. A tilting of the cutting link in a direction opposite to the running direction is thereby avoided so that the free angle provided at the tooth roof cannot change and is preferably 7°. If the side link arranged at the other longitudinal side of the saw chain and disposed parallel to the cutting link is provided with running surfaces corresponding to those of the cutting link, then a lateral tilting of the cutting link is also counteracted.

BRIEF DESCRIPTION OF THE DRAWINGS

The invention will now be described with reference to the drawings wherein:

FIG. 2 is a side elevation view of the cutting tooth of another embodiment of the cutting link according to the invention;

FIG. 3 is a side elevation view of the cutting tooth of the cutting link showing the top portion having a rounded configuration according to another embodiment of the cutting link according to the invention;

DESCRIPTION OF THE PREFERRED EMBODIMENTS OF THE INVENTION

Figure 1:
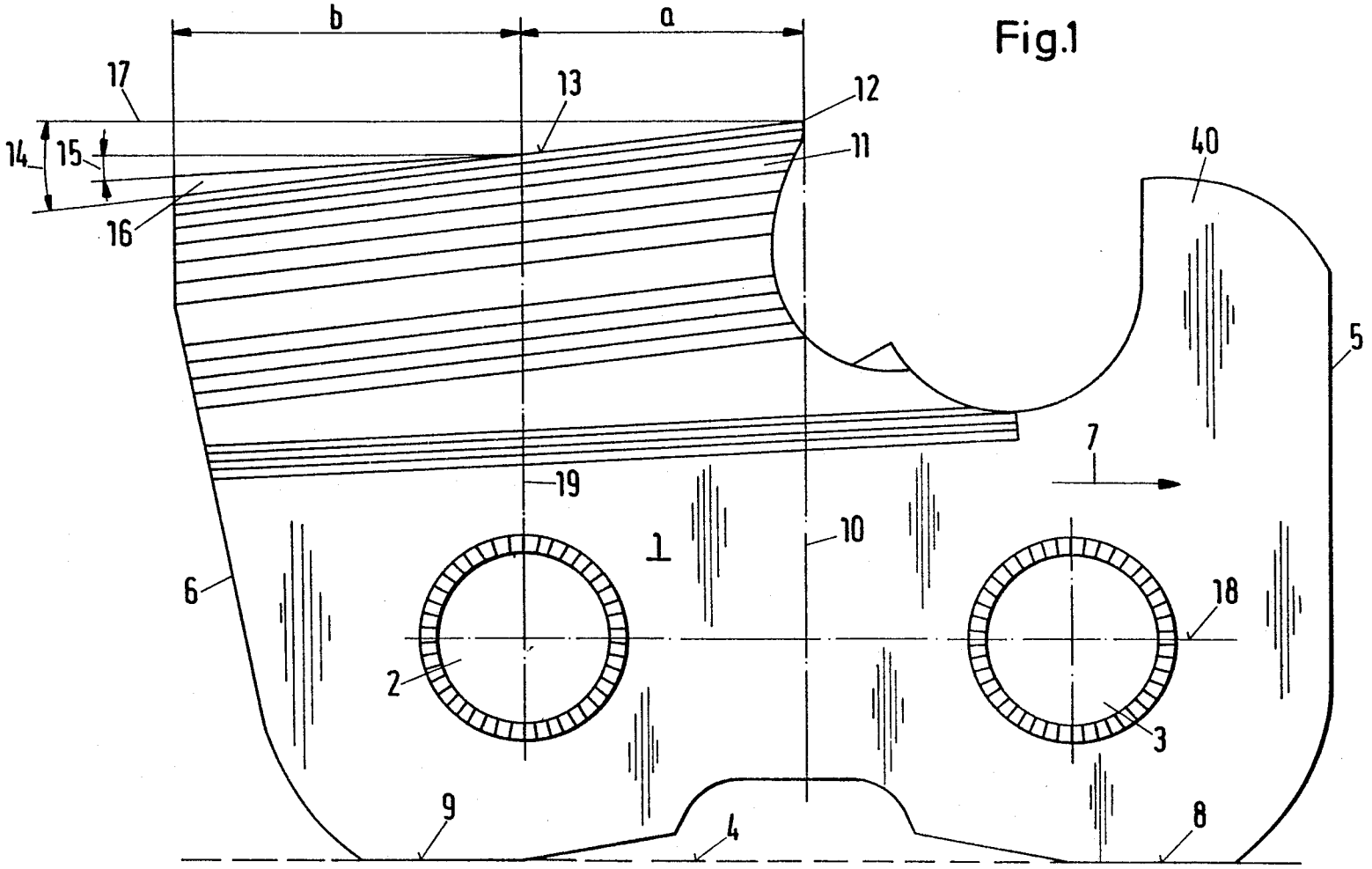
FIG. 1 is a side elevation view of a cutting link according to the invention.

The cutting link shown in the embodiment of FIG. 1 includes a base body 1 having two rivet openings (2, 3) with the center points thereof lying on a straight line 18 parallel to the guide surface 4. The rivet openings (2, 3) are arranged such that the spacing of the leading rivet opening 3 to the leading edge 5 is approximately the same as the spacing of the trailing rivet opening 2 to the trailing edge 6. In addition, the rivet openings (2, 3) are at a spacing from each other which is bisected by the center perpendicular 10.

The base body 1 has a lower edge defining a forward running surface 8 and a rearward running surface 9. The forward running surface 8 begins approximately beneath the leading rivet opening 3 and extends to the leading edge 5; whereas, the rearward running surface 9 begins approximately beneath the trailing rivet opening 2 and extends to the rearward trailing edge 6.

A cutting tooth 11 is formed on the base body 1 above the trailing rivet opening 2. The cutting tooth 11 has a cutting edge 12 approximately at the position of the center perpendicular 10. A depth limiter 40 is formed on the base body 1 ahead of the cutting edge 12 and determines the depth of penetration of the cutting edge 12. It can be advantageous to configure the cutting link according to the invention without a depth limiter 40 and to provide the latter on a link of the saw chain running ahead of the cutting tooth 11.

The cutting roof 13 extends from the cutting edge 12 and has a length which extends in a direction opposite to the running direction 7. Over this length, the cutting roof 13 has a varying free angle to the cutting plane which is indicated in FIG. 1 by the straight line 17 which represents the base of the kerf cut by the saw chain in wood. The cutting plane 17 lies parallel to the guide surface 4 of the guide bar (not shown) of a motor-driven chain saw on which the running surfaces 8 and 9 of the cutting link are braced as the saw chain moves around the guide bar.

The tooth roof 13 of the embodiment shown in FIG. 1 is configured to have two angles of different magnitude along its length. The first segment (a) of the tooth roof 13 extends directly from the cutting edge 12 and has a free angle 14 of preferably 7°. The second segment (b) of the tooth roof 13 extends in a direction opposite to the running direction 7 and defines a smaller free angle 15 which lies preferably in the order of magnitude of between 3° and 6° and is preferably 5°. The smaller free angle 15 in segment (b) can be obtained in a simple manner by providing a wedge-shaped material layer 16.

When in use, the cutting link wears at its running surfaces 8 and 9 as well as at its cutting edge 12 which is especially worn because of sharpening. The wearing of the cutting edge 12 causes the latter to be displaced rearwardly opposite to the running direction 7. It has been shown that the rearward running surface 9 wears more than the forward running surface 8 causing the cutting link to tilt toward the rear in a direction opposite to the running direction 7. The connecting line 18 of both center points of the rivet openings (2, 3) then no longer lies parallel to the guide surface 4; instead, this connecting line and the running surface 4 conjointly define an acute angle opening in the running direction 7.

This tilting is caused by the intense wear at the rearward running surface 9 and leads to an enlargement of the actual free angle at the tooth roof 13. The segments (a) and (b) corresponding to the different free angles 14 and 15, respectively, are selected to have a length such that for a tilting of, for example, more than 1°, the displacement of the cutting edge in a direction opposite to the running direction 7 caused by wear and resharpening is obtained up to the beginning of the segment (b) having the smaller free angle 15. The free angle which is actually present at the segment (b) is made up from the angle predetermined from the configuration of the cutting link (for example, 5°) and the angle (for example, 1°) resulting from the tilting of the cutting link. This actual free angle amounting to 6° provides the assurance that the cutting edge 12 can cut into wood with a uniform cutting performance. An enlargement of the free angle 14 resulting as a consequence of wear at the tooth roof 13 above the maximum free angle (of 7°, for example) is avoided with the configuration according to the invention over a long period of operational use. In this way, a vibration-free running of the saw chain with an approximately uniform cutting capacity is obtained over a long period of operational use.

In the embodiment of FIG. 1, the segments (a) and (b) come together at precisely the vertical line 19 at the center point of the trailing rivet opening 2.

Another embodiment of the invention is shown in FIG. 2 wherein the tooth roof 13 is subdivided into several straight-line component sections (c, d, e and f) having respective free angles (20, 21, 22, 23) which become smaller in a stepwise manner. In lieu of the straight-line component segments, curved portions can also be advantageous. Such a configuration assures that the optimal free angle will be maintained with only slight fluctuations in magnitude during the entire period of operational use of the cutting link. In this respect, it can be advantageous to configure the tooth roof 13 so that it is made up of curved component segments of respectively different free angles. In this respect, and especially in lieu of the jump-like changes of the free angle over the length of the tooth roof 13, a convex tooth roof curve having a continuously changing free angle can be provided (FIG. 3) having a radius of curvature corresponding to the additional wear of the rearward running surface 9 to be expected. With such a curve adapted to the increased wear, an almost constant free angle is obtained over a long period of operational use which makes its precise adjustment possible.

Figure 4:
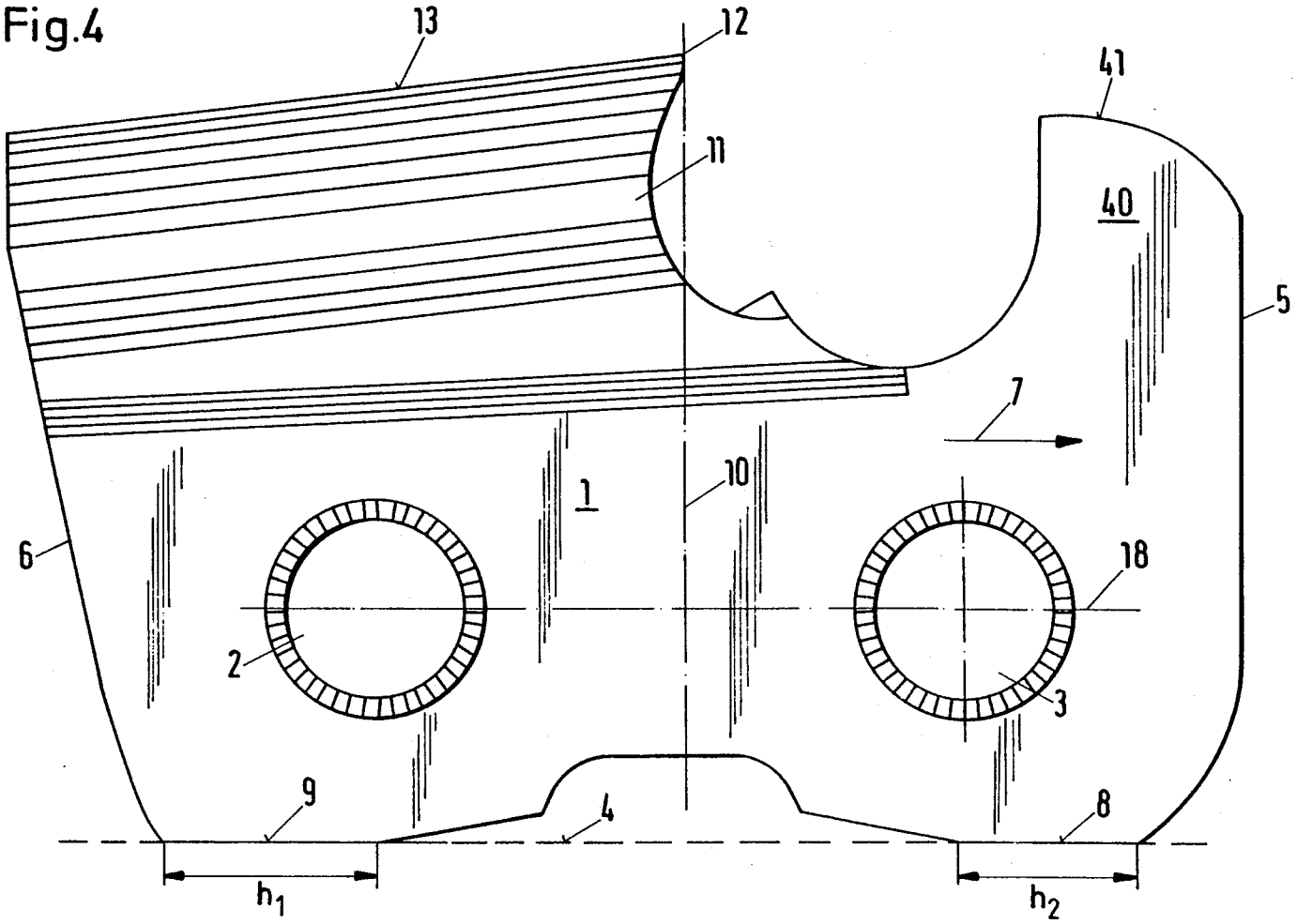
FIG. 4 is a side elevation view of another embodiment of the cutting link according to the invention wherein the forward and rearward running surfaces have different lengths; and, FIG. 5 is a side elevation view of still another embodiment of the cutting link according to the invention equipped with a modified depth limiter.
Figure 5:
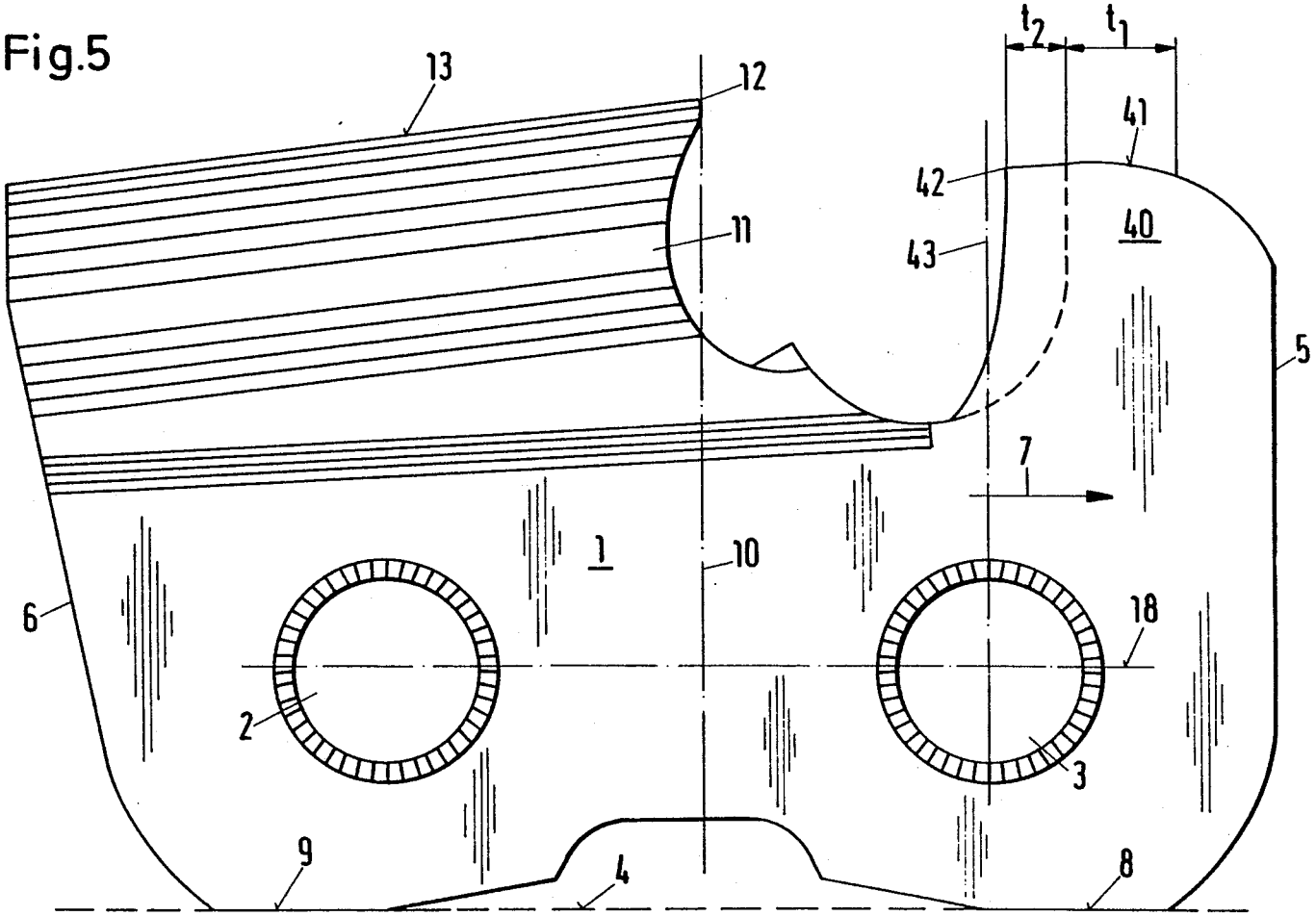

Another embodiment of the invention for obtaining a uniform cutting performance is shown in FIG. 4. In order to avoid a tilting of the base body with an enlargement of the free angle, the rearward running surface 9 of the cutting link is configured so as to be larger than the forward running surface 8. Preferably, the rearward running surface 9 is longer which is obtained by an appropriate configuration of the lower edge of the base body without a large manufacturing expense. The length difference $h_1-h_2$ is dimensioned such that the amount of material removed through wear with respect to elevation is approximately the same at both running surfaces 8 and 9, so that the connecting line 18 of the center points of the rivet openings 2 and 3 does not significantly change its position over the period of operational use of the cutting link. In this way, the cutting link does not change its position with respect to the guide surface 4 over the entire period of operational use of the saw chain so that the free angle 14 of the tooth roof 13 also remains unchanged. The tooth roof 13 itself can therefore be configured to have a single free angle of preferably 7° which is pregiven over its entire length.

It can be advantageous to not only provide the cutting link itself with running surfaces of different lengths but to also provide the side link with the running surfaces of different lengths corresponding to the cutting link with the side link being disposed parallel to the cutting link and on the other longitudinal side of the saw chain at the same location so that the saw chain even after a long period of operational use does not change its supporting position in the guide slot of the guide bar. The cutting link will therefore also not tilt to the side.

In a further embodiment of the invention, the rearward running surface 9 is so configured that its surface in contact engagement with the guide surface increases with increasing wear more than the forward running surface. In this way, a tilting in a direction opposite to the running direction 7 is actively counteracted.

In the context of the invention, it can be advantageous to configure the tooth roof 13 as in the embodiments according to FIGS. 1 to 3 while also providing different running surfaces as shown in FIG. 4.

In order to obtain a reliable support of the cutting link at the base of the kerf, the supporting surface 41 of the depth limiter 40 which leads the cutting tooth 11 is extended by an amount $t_2$ in the direction toward the cutting tooth 11. The trailing edge 42 of the supporting surface 41 faces toward the cutting tooth 11 and ends approximately at the perpendicular 43 passing through the center point of the leading rivet opening 3. The total length $(t_1+t_2)$ of the supporting surface 41 measured in the direction of movement 7 supports itself during cutting on the base of the kerf whereby a portion of the forces acting on the rearward running surface 9 are taken up so that wear at the running surface 9 is reduced. The total length $(t_1+t_2)$ of the supporting surface 41 of the depth limiter 40 is so selected that either in combination with the solution shown in the embodiment of FIG. 4, a uniform wear of the running surfaces 8 and 9 is obtained or, in combination with a tooth roof of different free angles only low fluctuations occur about an optimal free angle.

An advantageous configuration of the cutting link can also be obtained in that the tooth roof 13 is provided with different free angles over its length and the running surfaces 8 and 9 at the lower edge of the base body are configured to have different lengths. In addition, the supporting surface 41 of the depth limiter 40 is extended toward the cutting tooth.

It is understood that the foregoing description is that of the preferred embodiments of the invention and that various changes and modifications may be made thereto without departing from the spirit and scope of the invention as defined in the appended claims.

What is claimed is:

1. A cutting link for a saw chain of a motor-driven chain saw having a guide bar defining a track along and on which the saw chain moves in a direction to cut a kerf in wood with the kerf having a kerf base, the saw chain including a plurality of cutting links and a plurality of other links pivotally interconnected by rivets, each of the cutting links comprising:

a base body having a forward wall portion defining a leading rivet opening having a center;

said base body having a rearward wall portion defining a trailing rivet opening having a center;

said centers defining an imaginary center line extending therethrough and said center line having a predetermined spatial orientation with respect to the track of the guide bar;

said base body having a lower edge defining a forward running foot surface of length $(h_2)$ disposed approximately beneath said leading rivet opening for contact engaging the track of the guide bar;

said lower edge also defining a rearward running foot surface of length $(h_1)$ disposed approximately beneath said trailing rivet opening for also contact engaging the track of the guide bar;

said rearward wall portion extending upwardly to form a cutting tooth defining a cutting edge and having a tooth roof extending rearwardly of said cutting edge with said cutting edge moving along said kerf base parallel to the track as the cutting link moves in said direction;

said tooth roof and said kerf base defining a free angle selected to permit said cutting link to cut into a material thereby applying a tilting force to said cutting link which is opposite to said direction causing said rearward running foot surface to be subjected to a greater reaction force from said track than said forward running foot surface; and, said length $(h_1)$ of said rearward running foot surface being greater than said length $(h_2)$ of said forward running foot surface with the difference $(h_1-h_2)$ of said lengths being selected so as to cause the amount of material removed through wear at both of said foot surfaces to be approximately equal with respect to elevation so as to maintain said predetermined spatial orientation of said center line substantially constant with respect to said track during the operational use of the cutting link thereby causing said free angle to remain substantially constant during said use of the cutting link in the saw chain.

2. The cutting link of claim 1, said lower edge at said rearward running foot surface being configured so as to cause said rearward running foot surface to become larger than said forward running foot surface with increasing wear.

3. A cutting link for a saw chain of a motor-driven chain saw having a guide bar defining a track along and on which the saw chain moves in a given running direction to cut a kerf in wood with the kerf having a kerf base, the saw chain including a plurality of cutting links and a plurality of other links pivotally interconnected by rivets, each of the cutting links comprising:

a base body having a forward wall portion defining a leading rivet opening having a center;

said base body having a rearward wall portion defining a trailing rivet opening having a center;

said centers defining an imaginary center line extending therethrough and said center line having a spatial position with respect to the track of the guide bar;

said base body having a lower edge defining a forward running foot surface disposed approximately beneath said leading rivet opening for contact engaging the track of the guide bar;

said lower edge also defining a rearward running foot surface disposed approximately beneath said trailing rivet opening for also contact engaging the track of the guide bar;

said rearward running foot surface being worn down more than said forward running foot surface causing the cutting link to tilt toward the rear in a direction opposite to the running direction of the saw chain thereby causing said center line and the track to conjointly define an acute angle which increases in magnitude during the operational use of the cutting link;

said rearward wall portion extending upwardly to form a cutting tooth defining a cutting edge movable along the kerf base parallel to the track as the cutting link moves in said direction;

said cutting tooth having a tooth roof extending rearwardly from said cutting edge to define an effective free angle with said kerf base at which said cutting edge cuts into the wood;

said tooth roof having a predetermined length extending rearwardly from the cutting edge and being subdivided along said length into a forward segment and a rearward segment;

said forward segment and said kerf base defining a first free angle which increases as said acute angle increases during a free period of said operational use; and, said rearward segment and said kerf base defining a second free angle having a magnitude less than said first free angle so as to compensate for the increase in magnitude of said acute angle by reducing the effective free angle at which said cutting edge cuts into the wood after said forward segment is worn away at the end of said first period of operational use thereby permitting said cutting edge to cut into the wood with a substantially uniform cutting performance.

4. The cutting link of claim 3, said forward wall portion extending upwardly to form a depth limiter disposed ahead of said cutting tooth.

5. The cutting link of claim 3, said tooth roof being subdivided along said length into a plurality of segments arranged one behind the other, each one of said segments and said cutting plane defining a free angle with the free angle corresponding to each segment being less than the free angle of the segment directly forward thereof

6. The cutting link of claim 5, said tooth roof having a rearward end facing away from said cutting edge; and, said free angles corresponding to the segments of said tooth roof and being ever smaller in a stepwise manner proceeding from said cutting edge to said rearward end.

7. The cutting link of claim 3, said tooth roof being subdivided into a plurality of straight segments arranged one behind the other, each one of said segments and said cutting plane defining a free angle with the free angle corresponding to each segment being different from the respective free angles corresponding to the remaining ones of said segments.

8. The cutting link of claim 3, said rearward segment being formed by an approximately wedge-shaped piece applied to said tooth roof.

9. A cutting link for a saw chain of a motor-driven chain saw having a guide bar defining a track along and on which the saw chain moves in a given direction, the saw chain including a plurality of cutting links and a plurality of other links pivotally interconnected by rivets, each of the cutting links comprising:

a base body having a forward wall portion defining a leading rivet opening;

said base body having a rearward wall portion defining a trailing rivet opening;

said base body having a lower edge defining a forward running surface disposed approximately beneath said leading rivet opening for contact engaging the track of the guide bar;

said lower edge also defining a rearward running surface disposed approximately beneath said trailing rivet opening for also contact engaging the track of the guide bar;

said rearward wall portion extending upwardly to form a cutting tooth defining a cutting edge and having a tooth roof extending rearwardly from said cutting edge with said cutting edge moving in a cutting plane parallel to the track as the cutting link moves in said direction;

said tooth roof having a predetermined length extending rearwardly from said cutting edge and being subdivided along said length into a forward curved segment and a rearward curved segment;

said forward curved segment and said cutting plane defining a first free angle;

said rearward curved segment and said cutting plane defining a second free angle having a magnitude less than said first free angle; and, said tooth roof being subdivided into said first forward curved segment, said rearward curved segment and at least one intermediate curved segment arranged between said forward curved segment and said rearward curved segment;

said intermediate curved segment and said cutting plane also defining a free angle with the free angle corresponding to each segment being different from the respective free angles corresponding to the remaining ones of said segments.

10. A cutting link for a saw chain of a motor-driven chain saw having a guide bar defining a track along and on which the saw chain moves in a given direction, the saw chain including a plurality of cutting links and a plurality of other links pivotally interconnected by rivets, each of the cutting links comprising:

a base body having a forward wall portion defining a leading rivet opening;

said base body having a rearward wall portion defining a trailing rivet opening;

said base body having a lower edge defining a forward running surface disposed approximately beneath said leading rivet opening for contact engaging the track of the guide bar;

said lower edge also defining a rearward running surface disposed approximately beneath said trailing rivet opening for also contact engaging the track of the guide bar;

said rearward wall portion extending upwardly to form a cutting tooth defining a cutting edge and having a tooth roof extending rearwardly from said cutting edge from said cutting edge moving in a cutting plane parallel to the track as the cutting link moves in said direction;

said tooth roof having a predetermined length extending rearwardly from said cutting edge and being subdivided along said length into a forward segment and a plurality of rearward segments disposed one behind the other;

said forward segment and said cutting plane defining a first free angle;

said rearward segments and said cutting plane defining a plurality of free angles with said cutting plane, respectively; and, said tooth roof having a rearward end facing away from said cutting edge; and, said segments being configured so as to cause said free angles to become continuously smaller proceeding from said cutting edge to said rearward end.

11. A cutting link for a saw chain of a motor-driven chain saw having a guide bar defining a track along and on which the saw chain moves in a given direction, the saw chain including a plurality of cutting links and a plurality of other links pivotally interconnected by rivets, each of the cutting links comprising:

a base body having a forward wall portion defining a leading rivet opening;

said base body having a rearward wall portion defining a trailing rivet opening;

said base body having a lower edge defining a forward running surface disposed approximately beneath said leading rivet opening for contact engaging the track of the guide bar;

said lower edge also defining a rearward running surface disposed approximately beneath said trailing rivet opening for also contact engaging the track of the guide bar;

said rearward wall portion extending upwardly to form a cutting tooth defining a cutting edge and having a tooth roof extending rearwardly from said cutting edge with said cutting edge moving in a cutting plane parallel to the track as the cutting link moves in said direction;

said tooth roof having a predetermined length extending rearwardly from said cutting edge and being subdivided along said length into a forward segment and a rearward segment;

said forward segment and said cutting plane defining a first free angle;

said rearward segment and said cutting plane defining a second free angle having a magnitude less than said first free angle; and, said first free angle being approximately 7° and said second free angle being in the range of approximately 3° to 6°.

12. The cutting link of claim 11, said second free angle being 5°.

13. A cutting link for a saw chain of a motor-driven chain saw having a guide bar defining a track along and on which the saw chain moves in a given direction to cut a kerf in wood with the kerf having a kerf base, the saw chain including a plurality of cutting links and a plurality of other links pivotally interconnected by rivets, each of the cutting links comprising:

a base body having a forward wall portion defining a leading rivet opening having a center;

said base body having a rearward wall portion defining a trailing rivet opening having a center;

said centers defining an imaginary center line extending therethrough and said center line having a spatial position with respect to the track of the guide bar;

said base body having a lower edge defining a forward running foot surface disposed approximately beneath said leading rivet opening for contact engaging the track of the guide bar;

said lower edge also defining a rearward running foot surface disposed approximately beneath said trailing rivet opening for also contact engaging the track of the guide bar;

said rearward wall portion extending upwardly to form a cutting tooth defining a cutting edge and having a tooth roof extending rearwardly of said cutting edge with said cutting edge moving along said kerf base parallel to the track as the cutting link moves in said direction;

said tooth roof and said kerf base defining a free angle selected to permit said cutting link to cut into a material thereby applying a tilting force to said cutting link which is opposite to said direction causing said rearward running foot surface to be subjected to a greater reaction force from said track than said forward running foot surface;

said rearward running foot surface having a length greater than the length of said forward running foot surface so as to cause the wear at said running foot surfaces to be such that a change of said spatial position during operational use of the cutting link is slowed;

said tooth roof having a predetermined length extending rearwardly from said cutting edge and being subdivided along said length into a forward segment and a rearward segment;

said forward segment defining a first slope with respect to said kerf base which increases as said spatial position changes during a first period of said operational use;

said rearward segment defining a second slope with respect to said kerf base having a magnitude less than said first slope; and, the lengths of said foot surfaces and the difference in said slopes coacting to cause said free angle to remain substantially constant during the operational use of the cutting link in the saw chain.

14. A saw chain for a motor-driven chain saw having a guide bar defining a track along and on which the saw chain moves in a given direction to cut a kerf in wood with the kerf having a kerf base, the saw chain comprising:

a plurality of cutting links and a plurality of other links pivotally interconnected by rivets; each of the cutting links including:

a base body having a forward wall portion defining a leading rivet opening having a center;

said base body having a rearward wall portion defining a trailing rivet opening having a center;

said centers defining an imaginary center line extending therethrough and said center line having a spatial position with respect to the track of the guide bar;

said base body having a lower edge defining a forward running foot surface disposed approximately beneath said leading rivet opening for contact engaging the track of the guide bar;

said lower edge also defining a rearward running foot surface disposed approximately beneath said trailing rivet opening for also contact engaging the track of the guide bar;

said rearward running foot surface being worn down more than said forward running foot surface causing the cutting link to tilt toward the rear in a direction opposite to the running direction of the saw chain thereby causing said center line and the track to conjointly define an acute angle which increases in magnitude during the operational use of the cutting link;

said rearward wall portion extending upwardly to form a cutting tooth defining a cutting edge movable along said kerf base parallel to the track as the cutting link moves in said direction;

said cutting tooth having a tooth roof extending rearwardly from said cutting edge to define an effective free angle with said kerf base at which said cutting edge cuts into the wood;

said tooth roof having a predetermined length extending rearwardly from said cutting edge and being subdivided along said length into a forward segment and a rearward segment;

said forward segment and said kerf base defining a first free angle which increases as said acute angle increases during a first period of said operational use;

said rearward segment and said kerf base defining a second free angle having a magnitude less than said first free angle so as to compensate for the increase in magnitude of said acute angle by reducing the effective free angle at which said cutting edge cuts into the wood after said forward segment is worn away at the end of said first period of operational use thereby permitting said cutting edge to cut into the wood with substantially uniform cutting performance; and, depth limiter means disposed ahead of said cutting tooth.

15. The saw chain of claim 14, said depth limiter means being a depth limiter formed on said forward wall portion of each of said cutting links.

16. A saw chain of a motor-driven chain saw having a guide bar defining a track along and on which the saw chain moves in a given direction to cut a kerf in wood with the kerf having a kerf base, the saw chain comprising:

a plurality of cutting links and a plurality of other links pivotally interconnected by rivets, each of the cutting links including:

a base body having a forward wall portion defining a leading rivet opening having a center;

said base body having a rearward wall portion defining a trailing rivet opening having a center;

said centers defining an imaginary center line extending therethrough and said center line having a predetermined spatial orientation with respect to the track of the guide bar;

said base body having a lower edge defining a forward running foot surface of length ($h_2$) disposed approximately beneath said leading rivet opening for contact engaging the track of the guide bar;

said lower edge also defining a rearward running foot surface of length ($h_1$) disposed approximately beneath said trailing rivet opening for also contact engaging the track of the guide bar;

said rearward wall portion extending upwardly to form a cutting tooth defining a cutting edge and having a tooth roof extending rearwardly of said cutting edge with said cutting edge moving along said kerf base parallel to the track as the cutting link moves in said direction;

said tooth roof and said kerf base defining a free angle selected to permit said cutting link to cut into a material thereby applying a tilting force to said cutting link which is opposite to said direction causing said rearward running foot surface to be subjected to a greater reaction force from said track than said forward running foot surface;

said length ($h_1$) of said rearward running foot surface being greater than said length ($h_2$) of said forward running foot surface with the difference ($h_1$–$h_2$) of said lengths being selected so as to cause the amount of material removed through wear at both of said foot surfaces to be approximately equal with respect to elevation so as to maintain said predetermined spatial orientation of said center line substantially constant with respect to said track during the operational use of the cutting link thereby causing said free angle to remain substantially constant during said use of the cutting link in the saw chain; and, depth limiter means disposed ahead of said cutting tooth.

17. The saw chain of claim 16, said depth limiter means being a depth limiter formed on said forward wall portion of each of said cutting links.

* * * * *

UNITED STATES PATENT AND TRADEMARK OFFICE

CERTIFICATE OF CORRECTION

PATENT NO. : 4,979,416

DATED : December 25, 1990

INVENTOR(S) : Karl Nitschmann

It is certified that error appears in the above-identified patent and that said Letters Patent is hereby corrected as shown below:

In column 1, line 6: between "for" and "chain" insert -- a saw -- therefor.

In column 1, line 68: between "capacity and "Known" insert -- . --.

In column 6, line 11: between "a" and "direction" insert -- given --.

In column 7, line 34: delete "the" and substitute -- said -- therefor.

In column 7, line 60: delete "thereof" and substitute -- thereof. -- therefor.

Signed and Sealed this

Nineteenth Day of May, 1992

*Attest:*

DOUGLAS B. COMER

*Attesting Officer*

*Acting Commissioner of Patents and Trademarks*